US010787280B2

(12) United States Patent
Herlin et al.

(10) Patent No.: US 10,787,280 B2
(45) Date of Patent: Sep. 29, 2020

(54) METHOD OF PRODUCING AND FILLING A PACKAGING CONTAINER

(71) Applicant: Å&R Carton Lund Aktiebolag, Lund (SE)

(72) Inventors: Henrik Herlin, Kristianstad (SE); Simon Holka, Staffanstorp (SE); Eva Sunning, Lund (SE); Lennart Aveling, Höllviken (SE)

(73) Assignee: Å&R Carton Lund Aktiebolag (SE)

( * ) Notice: Subject to any disclaimer, the term of this patent is extended or adjusted under 35 U.S.C. 154(b) by 308 days.

(21) Appl. No.: 15/549,053

(22) PCT Filed: Feb. 2, 2016

(86) PCT No.: PCT/SE2016/050078

§ 371 (c)(1),
(2) Date: Aug. 4, 2017

(87) PCT Pub. No.: WO2016/126193

PCT Pub. Date: Aug. 11, 2016

(65) Prior Publication Data

US 2018/0016038 A1 Jan. 18, 2018

(30) Foreign Application Priority Data

Feb. 5, 2015 (SE) ..... 1550125

(51) Int. Cl.
*B65B 1/04* (2006.01)
*B65B 1/02* (2006.01)
(Continued)

(52) U.S. Cl.
CPC ..... *B65B 1/04* (2013.01); *B65B 1/02* (2013.01); *B65B 1/06* (2013.01); *B65B 7/168* (2013.01);
(Continued)

(58) Field of Classification Search
CPC .... B65B 1/02; B65B 1/04; B65B 1/06; B65B 1/26; B65B 7/168; B65B 7/2857;
(Continued)

(56) References Cited

U.S. PATENT DOCUMENTS 4,883,193 A * 11/1989 Christensson ..... B65D 15/22 220/266
7,169,418 B2 * 1/2007 Dalton ..... B65D 21/0217 220/366.1
(Continued)

FOREIGN PATENT DOCUMENTS

CN 1914096 A 2/2007
CN 103895952 A 7/2014
(Continued)

OTHER PUBLICATIONS

Chinese Search Report for Application No. CN201680004067.X dated Nov. 6, 2018.
(Continued)

*Primary Examiner* — Hemant Desai
*Assistant Examiner* — Veronica Martin
(74) *Attorney, Agent, or Firm* — Lerner, David, Littenberg, Krumholz & Mentlik, LLP

(57) ABSTRACT

A method of producing and filling a paperboard packaging container with pulverulent bulk solids includes forming a tubular container body from a paperboard sheet, the body having upper and lower body openings and a container wall extending between the upper and lower body openings and having inner and outer surfaces; closing the upper body opening with a sealing membrane attached to the inner surface; providing an upper reinforcing rim; inserting at least a lower part of the upper reinforcing rim into the tubular container body at the upper body opening; forming a weld seal between the inner surface and the inserted part
(Continued)

of the upper reinforcing rim; presenting the body to a filling station with the bottom body opening of the container body directed upward in a vertical direction; filling pulverulent material into the body through the upwardly directed bottom body opening; and closing the bottom body opening.

12 Claims, 5 Drawing Sheets

(51) Int. Cl.

| | |
|---|---|
| ***B65D 3/12*** | (2006.01) |
| ***B65B 1/06*** | (2006.01) |
| ***B65D 3/04*** | (2006.01) |
| ***B65B 7/16*** | (2006.01) |
| ***B65B 7/28*** | (2006.01) |
| ***B65D 43/16*** | (2006.01) |
| ***B65B 31/00*** | (2006.01) |
| *B65B 31/04* | (2006.01) |

(52) U.S. Cl.
CPC ..... *B65B 7/28* (2013.01); *B65B 7/2878* (2013.01); *B65B 31/00* (2013.01); *B65D 3/04* (2013.01); *B65D 3/12* (2013.01); *B65D 43/163* (2013.01); *B65B 31/04* (2013.01); *B65D 2543/0024* (2013.01); *B65D 2543/00083* (2013.01); *B65D 2543/00175* (2013.01); *B65D 2543/00231* (2013.01); *B65D 2543/00296* (2013.01); *B65D 2543/00379* (2013.01); *B65D 2543/00398* (2013.01); *B65D 2543/00425* (2013.01); *B65D 2543/00435* (2013.01); *B65D 2543/00555* (2013.01)

(58) Field of Classification Search
CPC ..... B65B 7/2878; B65B 31/00; B65B 37/00; B65B 39/04
USPC ..... 53/433, 452, 456, 471, 478, 488, 242, 53/281
See application file for complete search history.

(56) References Cited

U.S. PATENT DOCUMENTS

| | | | | |
|---|---|---|---|---|
| 9,387,963 | B2 * | 7/2016 | McBroom | B65D 43/169 |
| 9,815,579 | B2 * | 11/2017 | Larsson | B65D 51/246 |
| 9,821,527 | B2 * | 11/2017 | Hagelqvist | B29C 65/7847 |
| 2004/0206052 | A1 * | 10/2004 | Shean | B65D 5/061 53/456 |
| 2008/0041861 | A1 * | 2/2008 | Crawford | B65D 25/2897 220/697 |
| 2010/0140129 | A1 * | 6/2010 | Sanfilippo | B65B 1/06 206/503 |
| 2010/0270301 | A1 * | 10/2010 | Cronin | B65D 43/14 220/200 |
| 2014/0109522 | A1 * | 4/2014 | Sanfilippo | B65B 61/182 53/456 |

FOREIGN PATENT DOCUMENTS

| | | | | |
|---|---|---|---|---|
| EP | 0312513 | A2 | 4/1989 | |
| EP | 0370982 | A1 | 5/1990 | |
| EP | 2716551 | A1 | 4/2014 | |
| WO | 8703536 | A1 | 6/1987 | |
| WO | 2013009227 | A1 | 1/2013 | |
| WO | WO-2013009227 | A1 * | 1/2013 | B29C 65/3656 |
| WO | 2013109174 | A1 | 7/2013 | |

OTHER PUBLICATIONS

International Search Report for Application No. PCT/SE2016/050078 dated May 10, 2016.

* cited by examiner

METHOD OF PRODUCING AND FILLING A PACKAGING CONTAINER

CROSS-REFERENCE TO RELATED APPLICATIONS

The present application is a national phase entry under 35 U.S.C. § 371 of International Application No. PCT/SE2016/050078 filed Feb. 2, 2016, published in English, which claims priority from Swedish Application No. 1550125-7 filed Feb. 5, 2015, all of which are incorporated by reference.

TECHNICAL FIELD

The invention pertains to a method of producing and filling a packaging container for solid pulverulent bulk material.

BACKGROUND

When packaging of consumer goods, and in particular when packaging dry flowable pulverulent consumer goods it is common to use rigid paperboard packaging containers which serve as protective transport and storage containers at the retail end and as storage and dispensing containers at the consumer end. Such paperboard containers are usually provided with an openable and closable lid, and with an inner removable or breakable barrier membrane which keeps the contents fresh and protected against contamination up until delivery of the packaging container to a consumer. Once the inner barrier has been destroyed in order to access the contents in the packaging container, the ability of the packaging container to protect the contents from detrimental influence from the environment depends strongly on the lid construction. It is a concern that the packaging container can continue to keep the contents in the packaging container fresh and protected against contamination from the outside also after the inner barrier has been removed. It is a particular concern that the packaging container may be repeatedly opened to access the contents in the container and be re-sealed to allow hygienic storage of the contents in the package between dispensing occasions. A packaging container for bulk solids usually contains more of the packaged product than will be used at each dispensing occasion. Thus, it is desirable that the product remaining in the packaging container retains properties such as flavor, scent, scoopability, vitamin content, color, etc. at least for a time period corresponding to the time it is expected it will take for a consumer to use up all the contents in the packaging container. It is an object of the present invention to offer a method of efficiently producing a hygienically sealed packaging container with improved capability of keeping contents in the packaging container fresh also after a protective sealing membrane has been removed.

SUMMARY

According to the invention, there is offered a method of producing a paperboard packaging container for bulk solids, in accordance with claim 1. Further embodiments are set out in the dependent claims.

The method of producing and filling a paperboard packaging container with pulverulent material as disclosed herein comprises the steps of:

a) forming a tubular container body from a paperboard sheet, the container body having an upper end with an upper body opening and a bottom end with a bottom body opening and a container wall extending in a height direction of the packaging container between the upper body opening and the bottom body opening, the container wall having an inner surface and an outer surface, an upper end edge and a bottom end edge;

b) closing the upper body opening with a sealing membrane which is attached to the inner surface of the container wall;

c) providing an upper reinforcing rim in the form of a closed loop having a main extension in a loop plane, the upper reinforcing rim having an outer contour and an inner contour and having a height in a height direction perpendicular to the loop plane with an upper rim part and a lower rim part in the height direction of the upper reinforcing rim;

d) inserting the lower rim part of the upper reinforcing rim and optionally also the upper rim part of the upper reinforcing rim into the tubular container body at the upper body opening with an upper end edge of the upper reinforcing rim being outside of the container body or flush with the upper end edge of the container wall;

e) forming a weld seal between the inner surface of the container wall and the inserted part of the upper reinforcing rim;

f) presenting the container body to a filling station with the bottom body opening of the container body directed upward in a vertical direction;

g) filling pulverulent material into the container body through the upwardly directed bottom body opening; and h) closing the bottom body opening.

Step b) i.e. closing of the upper body opening with the sealing membrane may alternatively be performed between steps e) and f) or between steps f) and g).

Accordingly, instead of applying the sealing membrane before applying the upper reinforcing rim, the sealing membrane may be applied after the upper reinforcing rim has been applied to the container body. A further alternative is to apply the sealing membrane from the bottom end of the container body, i.e. from the bottom end of the container body which may preferably be done after the container body has been turned upside-down in process step f). Expressed in other words, the sealing membrane can be applied at any suitable point in the process, as long as it is applied before the filling step g) where the sealing membrane is needed to keep the pulverulent material in the container body.

As used herein, a paperboard packaging container is a packaging container wherein the container body is formed from paperboard web material. The paperboard container may be formed in any manner known in the art, e.g. by forming a container body by bending the paperboard web material into a tubular shape and longitudinally closing the tube by joining overlapping or abutting side edges of the sheet material. The join between the side edges may be covered by a sealing strip. The container bottom may be formed from a separate bottom disc which is attached at one end of the container body tube or may be formed by folding an end portion of the container body tube.

As used herein, a paperboard web material is a material predominantly made from cellulose fibers or paper fibers. The web material may be provided in the form of a continuous web or may be provided as individual sheets of material. The paperboard material may be a single ply or multi ply material and may be a laminate comprising one or more layers of materials such as polymeric films and coatings, metal foil, etc. The polymeric films and coatings may include or consist of thermoplastic polymers. The paperboard material may be coated, printed, embossed, etc. and may comprise fillers, pigments, binders and other additives as known in the art. The paperboard materials as disclosed herein may also be referred to as cardboard or carton materials.

The packaging containers as disclosed herein are containers for bulk solids, which are flowable pulverulent materials capable of being poured or scooped out of the containers. The containers are generally disposable containers, which are discarded when they have been emptied of their contents. A concern in packaging containers for pulverulent bulk solids is that the containers are sufficiently tight or at least "sift-proof" to prevent the pulverulent material from escaping out of the container for example through a join between an upper reinforcing rim and the container wall. It has now been found that by welding a reinforcement rim to the inner surface of the container wall, a more reliably sift-proof join between the rim and the carton wall can be achieved, than with an adhesive seal. Furthermore, an adhesive seal requires a further component to be added to the packaging container as well as equipment for supplying and applying the adhesive. Consequently, a gluing process is generally more expensive and time-consuming than a weld process.

As used herein, the term "bulk solids" refers to a pulverulent solid material, e.g. in the form of particles, or powder. The bulk material may be dry or moist. Bulk solids in the context of the present application may be digestible, such as infant formula, coffee, tea, rice, flour, sugar, cereals, soup powder, custard powder, or the like. Alternatively, the bulk solids may be non-digestible, such as tobacco, detergent, fertilizer, chemicals or the like.

By a pulverulent material as used herein is implied any material in the form of particles, granules, grinds, plant fragments, short fibres, flakes, etc.

By an openable or peelable sealing membrane is meant a membrane that may be fully or partly removed by a user in order to provide initial access to an interior compartment of the packaging container either by breaking a seal between the sealing membrane and the inner surface of the container wall, or by tearing or otherwise breaking the sealing membrane itself. Tearable sealing membranes may be provided with one or more predefined weakenings, such as perforations or a cut partly through the membrane.

A peelable or tearable sealing membrane may be gastight or gas-permeable. A gastight membrane may be manufactured from any material or material combination suitable for providing a gastight sealing of a compartment delimited by the sealing membrane, such as aluminium foil, silicon-coated paper, plastic film, or laminates thereof. A gastight membrane is advantageous when the bulk solids stored in the packaging container are sensitive to air and/or moisture, and it is desirable to avoid contact of the packaged bulk solids with ambient air.

In the assembled and filled packaging container which is produced according to the method disclosed herein, the peelable or openable sealing membrane forms a cross-sectional seal between an inner compartment in the container body and the container opening. The inner peelable or openable sealing membrane is a transport and storage seal which is eventually broken or removed by an end user of the packaging container.

The sealing membrane is preferably placed at a distance from the upper end edge of the container body which allows the upper reinforcing rim to be attached to the inner surface of the body wall between the sealing membrane and the upper end edge of the container body. Alternatively, an upwardly directed edge part of a breakable sealing membrane may extend into the weld join between the upper reinforcing rim and the inner surface of the container body wall. The distance between the sealing membrane and the upper end edge of the container body may be in the order of from 10 to 60 millimeters. If the sealing membrane is placed at a distance of from 30 to 60 millimeters from the upper end edge of the container body, the space above the sealing membrane may be used to accommodate a scoop or other utensil provided together with the packaged goods.

Depending on whether the sealing membrane is applied from the upper end of the container body or from the bottom end of the container body, the membrane edges which are joined to the inner surface of the container wall will be directed upward toward the upper body opening or downward, toward the bottom body opening. In an assembled and filled packaging container made according to the method as disclosed herein, a peelable sealing membrane which is attached with the membrane edges directed upward is more resistant to inadvertent peeling that may be caused by a higher pressure on the outside of the sealing membrane than inside the sealing membrane. On the other hand, a peelable sealing membrane which is attached with the membrane edges directed downward is more resistant to inadvertent peeling that may be caused by a higher pressure on the inside of the sealing membrane than on the outside of the sealing membrane.

In a packaging container having a large container body foot-print, and being provided with a peelable sealing membrane, it may be preferred that the sealing membrane is attached with the membrane edge directed downward, into the container. During filling of the container from the bottom end of the container, the contents are supported by the sealing membrane. In particular in large containers, there may be a risk that a week peel seal breaks open when exposed to the weight of the contents being filled into the container. The risk of such inadvertent peeling during the filling step may be lowered by applying the sealing membrane with the membrane edge downward into the container.

In the method disclosed herein, the upper end edge of the container body may be directed upward in the vertical direction and the bottom end edge may be directed downward in the vertical direction during steps d) and e), i.e. during application and attachment of the upper reinforcing rim at the opening end of the container body. Thereafter, step f) may involve turning the container body upside-down so that the upper end edge is directed downward in the vertical direction and the bottom end edge is directed upward in the vertical direction.

Alternatively, the upper reinforcing rim may be inserted into the container body and welded to the inner surface of the container wall while the container body is held in any suitable position, such as in a horizontal position or in a vertical position with the upper body opening directed downwardly in the vertical direction. In the latter case, there is no need to turn the container body before the filling step, as the bottom body opening is already directed upward when the container body is presented to the filling station.

By introducing the container body with the attached upper reinforcing rim into a filling station such that the bottom body opening is directed upward, the container body may be placed with the upper edge of the upper reinforcing rim resting on a horizontal surface. In this manner, the container body can be supported by the upper reinforcing rim during the remaining process steps without risking damaging an exposed paperboard edge. The upper reinforcing rim provides support and protection for the container body during process steps such as filling and closing of the packaging container, application of a lid, application of a frame structure with or without a lid component, and during any additional steps such as a de-gassing step, as disclosed herein.

The upper reinforcing rim makes it possible to fill the container from the bottom end, after the sealing membrane has been applied. When applying a sealing membrane after the packaging container has been filled with contents, it is almost impossible to avoid that some of the packaged pulverulent contents escapes past the edges of the sealing membrane due to the turbulence created when the membrane is moved into the container body and ends up on the outside of the sealing membrane, in the space between the sealing membrane and the upper end edge of the container body. A user opening a packaging container and finding an inner sealing membrane which is soiled by the packaged pulverulent material, will generally consider the packaging container to be less hygienic than would have been desired. Furthermore, some of the packaged pulverulent material may be trapped in the seal between the sealing membrane and the container wall, making the seal less tight than desired and making it difficult to accurately control the strength of the seal.

By attaching the sealing membrane before the packaging container is filled with pulverulent material, the risk of finding pulverulent material outside the sealing membrane in the upper end of the packaging container is eliminated as is the risk that the pulverulent material negatively affects the quality and the predictability of the properties of the seal between the sealing membrane and the container body wall.

The rigid upper reinforcing rim which is welded to the inner surface of the container body wall contributes to shape and stabilize the flexible paperboard container body opening edge and brings the container body wall to conform to the contour of the upper reinforcing rim and to be provided with a desired predetermined and stable shape.

The weld seal between the upper reinforcing rim and the container body may be formed by any suitable method with high frequency welding being preferred. In order to achieve a seal with a high level of tightness, the weld seal between the upper reinforcing rim and the container wall is preferably formed continuously around the upper body opening. However, if a seal with a lower level of tightness is sufficient, such as when it is only required that the seal is sift-proof and prevents the pulverulent contents in the packaging container from escaping past the weld seal, an intermittent weld join may provide a satisfactory seal.

By joining the upper reinforcing rim to the inner surface of the container wall by means of welding, it is possible to obtain a tighter and slimmer attachment than is possible with an adhesive attachment. The welded reinforcing rim is preferably a plastic rim and may be arranged to extend between the inner surface of the container wall and an inner surface of a container lid whereby the upper reinforcing rim contributes to create a continuous barrier between the container wall and the container lid.

The barrier properties of the packaging containers disclosed herein, may be designed to meet different requirements of tightness depending on the goods which is packaged in the packaging container. By way of example, in a packaging container for dried peas a lower barrier level may be sufficient than in a packaging container for e.g. infant formula which is highly sensitive to oxygen and moisture exposure. A combination of a gas-tight gasketing seal between the upper edge of the upper reinforcing rim and the inner surface of the container lid, and a gas-tight weld seal between the upper reinforcing rim and the inner surface of the container wall may offer a packaging container with excellent barrier properties also after the sealing membrane has been removed.

The packaging containers produced by the method as disclosed herein may preferably have barrier properties which remain largely unaltered even after removal of the inner sealing membrane. In other words, the contents in a closed packaging container may be equally well protected or nearly equally well protected regardless of whether the inner sealing membrane has been removed or not. This also means that the seal created by between the lid and the upper reinforcing rim and the weld seal between the upper reinforcing rim and the inner wall of the packaging container preferably have barrier properties offering the same level of protection of the packaged contents as the inner sealing membrane and other container components which separate the contents in the container from the environment outside the packaging container.

A packaging container having a volume of approximately 1 l may be considered to be gas-tight if it provides an oxygen barrier of approximately 0.006 cc oxygen/24 h or less at 23° C. and 50% relative humidity.

The welding process provides a highly controlled way of creating a join with a predetermined tightness between the plastic rim and the paperboard container wall. The join is made by supplying energy to heat and locally soften or melt one or more thermoplastic component in the plastic rim and/or on the inner surface of the container wall and by pressing the plastic rim and the container wall together in a direction perpendicular to the container wall. The thermoplastic material used to create the weld seal may be provided by the plastic rim, by a thermoplastic film or coating on the inner surface of the container wall, or by both the plastic rim and by a thermoplastic film or coating on the inner surface of the container wall. It may be preferred that the plastic rim is made from thermoplastic material. A thermoplastic rim may be produced by any suitable melt-forming process known in the art, such as injection molding. By controlling weld temperature, pressure and weld time, it is possible to adapt the welding process to the welded materials and to obtain a weld seam with a required level of tightness. Accordingly, the welding process is accurate and predictable and is an efficient way of producing a reliable seal with a predetermined level of tightness.

After filling of the packaging container with pulverulent material, the bottom end is closed to seal the pulverulent material in the inner compartment of the packaging container. Closing of the bottom end may be performed by attaching a bottom disc to the inner surface of the container wall. The bottom disc may be attached at a small inward distance from the bottom end edge of the container body wall to provide stackability and/or to facilitate application of a bottom rim at the bottom end of the container body. The attachment may be made by adhesive or by welding, with welding generally being preferred.

The bottom disc may be made from any suitable material such as paperboard, plastic, metal and laminates of such materials. A paperboard bottom disc may be attached by welding, such as by high frequency welding, to the inner surface of the container body wall. The bottom disc is shaped before insertion into the bottom body opening by bending the peripheral edges of the bottom disc to create a flange that can be welded to the inner surface of the container body wall 3. The weld seal between the bottom disc and the container body wall is much less sensitive to contamination by the packaged pulverulent material than is the weld seal between the inner sealing membrane and the inner surface of the container body wall. The bottom disc is generally thicker and more compressible than the sealing membrane and is easier to form into a tight seal with the container body wall. The amount of pulverulent material which escapes out of the packaging container when the bottom disc is inserted into the bottom body opening is very small. As the bottom disc is only inserted a very small distance into the container body, the insertion step generates only a minimum of turbulence at the surface of the packaged pulverulent material. The amount of pulverulent material which is lost in the closure step is thereby minimal. Any pulverulent material which ends up on the outside of the bottom disc after the packaging container has been closed can be easily removed and will not cause the packaging container to look of feel soiled.

Alternatively, the bottom end of the packaging container may be closed by any suitable method as known in the art such as by folding and sealing end portions of the container wall.

The method as disclosed herein may further comprise applying a frame structure by mechanically attaching the frame structure to the upper edge rim. A mechanical connection between the upper reinforcing rim and the frame structure may be accomplished by the provision of mating contours on the upper reinforcing rim and on the frame structure. Such mating contours preferably include snap-fit features such as interengaging ridges and tracks or protrusions and holes/cavities, etc.

The attachment between the frame structure and the upper reinforcing rim may be made by forming a snap-in connection between the frame structure and the upper reinforcing rim.

The mechanical connection between the upper reinforcing rim and the frame structure is preferably irreversible implying that once established the connection can only be broken by destroying or damaging the connected parts.

The frame structure may form part of a lid component, the lid component further comprising a lid part which is connected to the frame structure by a hinge. The lid part may be a complete lid or may be only part of a lid, which is assembled with one or more additional lid parts to form a container lid. By way of example, the lid part may be an outer lid part defining the shape and size of the portion of the lid which is exposed to the exterior of the packaging container and which is combined in the container lid with an inner lid part such as an inner gasketing disc which provides an abutment surface cooperating with a corresponding abutment surface on the upper reinforcing rim to form a seal between the lid and the upper reinforcing rim. An inner gasketing disc may be made from carton, plastic, or any suitable laminate and may include resiliently compressible material such as natural or synthetic rubber or other resiliently compressible polymer materials which may contribute to a tight seal between the lid and the upper reinforcing rim.

By providing the frame structure or a lid component as a part which is separate from the upper reinforcing rim, the frame structure or lid component may be attached to the upper rim after the packaging container has been filled and the bottom end has been closed. A frame structure or lid component may have a three-dimensional profiled shape, with stacking features, decorative relief elements, locking elements, and other aberrations and irregularities. Furthermore, a lid part may have a non-planar surface, such as a rounded surface or an irregularly shaped surface. All such three-dimensional features make the packaging container difficult to handle in a bottom filling process as the packaging container cannot be safely rested on the non-planar upper surface. Moreover, plastic components having a complicated three-dimensional shape are comparatively expensive to manufacture, and can easily be damaged in a process where a packaging container is assembled and filled. By applying the frame structure or lid component after filling and closing the container, the number of packaging containers which are damaged in the process and which have to be discarded can be lowered. Accordingly, an upper closure comprising a lid and a two-part rim/frame construction as disclosed herein may serve to keep waste at a lower level than is possible with a conventional single part rim constructions. The upper reinforcing rim as disclosed herein has a simple shape without protruding features that may be damaged in a production process. Furthermore, the upper rim serves as a support and reinforcement of the container body during the manufacturing and filling process and protects the vulnerable container body paperboard edge from damage during the process. In the finished paperboard container, the upper rim contributes to stabilise and shape the container body during transport and storage.

A lid may be applied to the upper end of the container body after the container body has been filled with pulverulent material and the bottom end of the container body has been closed. The lid may either form at least a part of a lid component further comprising a frame structure, as set out herein, or may be a separate part.

The container lid may be a separate part of the packaging container which can be completely removed when opening the container. Alternatively, the container lid may be attached to a frame structure by means of a hinge. The hinge may be a live hinge, i.e. a bendable connection between the lid and the frame structure. A live hinge may be formed integral with the lid and/or with the frame structure or may be a separately formed element which is attached to the container lid and to the frame structure. Alternatively, the hinge may be a two-part hinge, with a first hinge part arranged on the container lid and a second hinge part arranged on the frame structure. A two-part hinge construction may be used to attach the container lid directly to the upper reinforcing rim If the lid comprises a first and a second lid part, the second lid part may be attached to the first lid part before or after attaching the lid component to a frame structure or to the upper reinforcing rim.

The method as disclosed herein may further comprise the steps of:

- providing a bottom reinforcing rim in the form of a closed loop extending in a bottom loop plane, the bottom reinforcing rim having a an outer contour and an inner contour and having a height in a height direction perpendicular to the bottom loop plane with an upper rim part and a lower rim part in the height direction of the bottom reinforcing rim;
- inserting the upper rim part of the bottom reinforcing rim and optionally also the lower rim part of the bottom reinforcing rim into the tubular container body at the bottom end edge with a lower end edge of the bottom reinforcing rim being outside of the container body or flush with the bottom end edge of the container wall; and
- attaching the bottom reinforcing rim to the inner surface of the container wall.

When the packaging container as disclosed herein is provided with a bottom rim, the bottom rim further contributes to shape and stabilize the container body bottom edge and the container body wall. As set out herein, the packaging container may be provided with any desired tubular shape by bringing the body wall edge to conform to a rigid plastic upper reinforcing rim having the desired footprint shape. The container body shape can optionally be further stabilised by means of a rigid bottom rim having the desired footprint shape. The bottom rim further contributes to improve stackability of the packaging containers as disclosed herein by cooperating with mating stacking elements at the upper part of the packaging containers.

The method as disclosed herein may comprise a degassing step which is performed in conjunction with the filling step. The degassing step may comprise supplying a protective gas to the flow of pulverulent material in the filling step. The protective gas may be nitrogen, carbon dioxide or a mixture of nitrogen and carbon dioxide. The protective gas may be blown into the flow of pulverulent material before the pulverulent material reaches the packaging container.

Alternatively or in addition thereto, the closing step may be performed in a protective gas atmosphere. When the pulverulent material is treated with protective gas in the filling step, the packaging containers are preferably conveyed to the closing step while maintaining the protective atmosphere, e.g. by moving the packaging containers through a tunnel filled with protective gas. Alternatively, the filled containers may be introduced in a vacuum chamber to draw off air whereafter the containers are subjected to a protected atmosphere and closed.

The pulverulent material which is packaged in the packaging container produced according to the method disclosed herein may be an alimentary or consumable material such as formula, tea, coffee, cocoa, sugar, flour, rice, peas, beans, tobacco, etc., as well as house-hold chemicals such as detergents and dishwasher powder. The pulverulent or granulated products which are suitable for packaging in the packaging containers as disclosed herein are flowable, which means that a desired amount of the product may be poured or scooped out of the packaging container.

The upper reinforcing rim may have any suitable cross-sectional profile as long as it can be fitted with at least a part of the upper reinforcing rim inside the upper body opening. Accordingly, the upper reinforcing rim may have a leg which is applied such that it extends downward in the container on the inner surface of the container wall. The upper reinforcing rim may be L-shaped and comprise a second leg extending over and covering the upper edge of the paperboard container body wall. The downwardly extending leg of an L-shaped upper reinforcing rim may have different thickness in different parts of the reinforcing rim. It may be preferred that no part of the upper reinforcing rim is arranged to extend downward on the outer surface of the paperboard container wall. A generally I-shaped or L-shaped upper reinforcing rim may be preferred as it can be readily inserted into the container body opening and be attached to the container wall by welding and application of pressure perpendicular to the container body wall.

The weld seal between the upper reinforcing rim and the container wall as is preferably a sift-proof seal, more preferably a moisture-proof seal and most preferably a gas-tight seal.

A higher level of tightness of the packaging container and any container seals may be desirable when the packaged goods is moisture sensitive and/or is sensitive to degradation when exposed to ambient air. It may also be desirable that the packaging container is aroma-proof in order to preserve flavours and aromas in the packaged goods and to prevent the packaged goods from taking up flavours and aromas from outside the packaging container.

The upper edge of the upper reinforcing rim may be arranged above the container body opening edge in the height direction of the packaging container. In this manner, it is ascertained that the upper end edge of the container wall is kept away from a surface on which the container body is resting during filling of the packaging container.

In a paperboard packaging container produced according to the method as disclosed herein, an inner profile of the upper reinforcing rim defines a shape and a size of an access opening, whereby the access opening is smaller than the container body opening. The opening area of the access opening is preferably from 85% to 99% of the container body opening area, such as from 90% to 98% of the container body opening area or from 94% to 97% of the container body opening area. The reinforcing rim preferably builds as little as possible into the container opening, such that the size of the access opening is maximized. A slim reinforcing rim and a large access opening make the contents in the packaging container easily accessible and contribute to facilitate scooping or pouring of the contents out of the container. Furthermore, a slim inner reinforcing rim minimizes the risk that pulverulent material is caught on the lower rim edge or between the rim and the container wall. A user opening a packaging container and seeing a soiled inner ring, will perceive the packaging container as being messy and less hygienic than desired. Furthermore, it is generally desired to keep the packaged pulverulent material away from the access opening where it is more exposed to contamination as it may more easily come into contact with the hands of a person opening the packaging container and removing contents through the access opening. Contaminated contents in the packaging container which are caught on the upper reinforcement rim may fall back into the container and may, in turn, contaminate the remaining contents in the container. In addition to the inner reinforcing rim being slim, the inwardly directed surface of the reinforcing rim is preferably generally smooth, without irregularities such as ridges and protrusion on which pulverulent contents in the container may get caught.

If the packaging container is provided with a frame structure which is mechanically connected with the upper reinforcing rim, it may be preferred that no part of the frame structure extends into the access opening and detracts from the area of the access opening. The frame structure may then serve to provide features such as a lid hinge, means for retaining the lid in a closed position over the access opening, locking elements, stacking elements, etc.

The upper reinforcing rim may further be configured with means for retaining the lid in a closed position. Such means may be constituted by snap-lock elements including mating ridges and grooves on the rim and on the lid, female/male locking elements, etc. as known in the art. In addition thereto, the closure arrangement on the paperboard packaging container may comprise a locking arrangement.

The locking arrangement may comprise a first locking element arranged on a frame structure if present, on the container body or on the upper reinforcing rim and a second locking element arranged on the container lid. The first and second locking elements may be mating locking elements, such as female/male locking elements including hooks and other protrusions which are arranged to interengage with ridges, hooks, tracks, holes, cavities, loops, etc. By way of example, a locking arrangement may be provided by a locking flap or clasp closure extending from an edge on the lid, such as from a forward edge on the lid and comprising at least one locking element which can be fastened into or onto a corresponding locking element on the container body or on the upper reinforcement rim or on a frame structure. The locking elements are preferably designed to allow repeated opening and closing of the locking arrangement. Manipulation of the locking arrangement may be facilitated by means of gripping devices such as finger grips, friction enhancing elements, pull tabs, etc.

As set out herein, the closure between the container lid and the edge rim or opening edge is preferably sift-proof and most preferably also gas tight or at least substantially gas tight. A tight closure between the container lid and the edge rim may be enhanced by mating contours on the lid and on the rim and may include snap-fit features such as interengaging ridges and tracks or protrusions and holes/cavities, etc.

The inner lid surface of the paperboard packaging container as disclosed herein may be constituted by an inner gasketing lid part which is arranged to abut against a corresponding part on the upper reinforcing rim to form a gasketing seal between the lid and the upper reinforcing rim when the lid is in a closed position over the container opening. The inner gasketing lid part may be a planar disk, and may be formed by any suitable material, such as paperboard, plastic, laminated paperboard, etc. The inner gasketing lid part preferably comprises resilient material which may be provided as a resilient coating or layer on the surface forming the inner lid surface. A resilient coating or layer may be applied over all or part of the inner lid surface but should preferably be applied at least within an area of the inner lid surface constituting an abutment surface.

The inner gasketing lid part may be attached to an outer lid part by adhesive or welding. However, it may be preferred that the inner gasketing lid part is mechanically attached to the outer lid part, such as by being snapped into a groove extending along the edge of the outer lid part, on an inner surface thereof.

A stacking member or stacking members at the container opening may be arranged peripherally on the container lid and/or on a frame structure connected to the upper reinforcing rim surrounding the access opening in the packaging container and/or on the upper reinforcing rim. Container lids may be provided with mating stacking members arranged on the upper outer surface and on the inner lower surface of each lid, making the lids separately stackable before being applied to a packaging container, e.g. in a process for producing the packaging containers as disclosed herein. In a similar fashion container lid components comprising a lid part hingedly connected to a frame may be provided with mating stacking members making the lid components separately stackable.

A stacking member at the container opening may take the form of a peripheral ledge on the outer lid surface or on the upper reinforcing rim or a frame connected to the reinforcing rim. When one container is stacked on top of another container, a bottom edge or bottom rim of the top container may be retained on the peripheral ledge.

As an alternative to a continuous or discontinuous ledge at the periphery of the outer lid surface, stacking members at the container opening may be provided as two or more support surfaces cooperating with corresponding stacking members at the bottom of the container. The stacking members at the bottom of the container may be in the form of a downwardly extending bottom edge as set out above or may be in the form of knobs or other protrusions providing a desired spacing between a container bottom disc and the peripheral ledge or other support surface on which the stacking member or members at the bottom of the container are resting when one container is stacked on top of another.

The container body of the packaging container as disclosed herein may have four main body wall portions; a front wall portion arranged opposite a rear wall portion and two opposing side wall portions extending between the front wall portion and the rear wall portion. The body wall portions are connected at corners or corner portions which may be formed between planar surfaces arranged at right angles to each other or may be curved or bevelled corner portions providing the packaging container with a softer, slightly rounded appearance. Moreover, the shape of the body wall portions may deviate from a planar shape, with one or more of the body wall portions having an outward or inward curvature. When the container body has one or more outwardly curved body wall portion the curvature of any such body wall portion is always lesser than the curvature of any curved corner portion, i.e. a radius of curvature of a corner portion in the container body of the packaging container as disclosed herein is always smaller than any radius of curvature of a body wall portion. A transition between a corner portion and a body wall portion may be seen as a distinct change in curvature or may be seen as a continuous change in curvature.

Furthermore, the container body can be made without any distinct body wall portions and may have any suitable foot-print shape, such as circular, oval or elliptic.

In paperboard containers, there is a conflict between minimizing the amount of paperboard material used in the containers and making the containers sufficiently rigid to avoid that the containers are damaged or that they collapse, e.g. when stacked for transport and storage. It has been found that by making all container walls only slightly outwardly curved, shape stability and rigidity of the packaging container may be considerably improved as compared to conventional packaging containers having planar walls. Accordingly, the radii of curvature of the upper and bottom end edges which govern the curvature of the container walls are preferably selected such that the container walls are provided with a near-planar shape, implying that the container walls are perceived by a consumer as being planar.

BRIEF DESCRIPTION OF THE DRAWINGS

The present invention will be further explained hereinafter by means of non-limiting examples and with reference to the appended drawings wherein.

DETAILED DESCRIPTION

Figure 1:
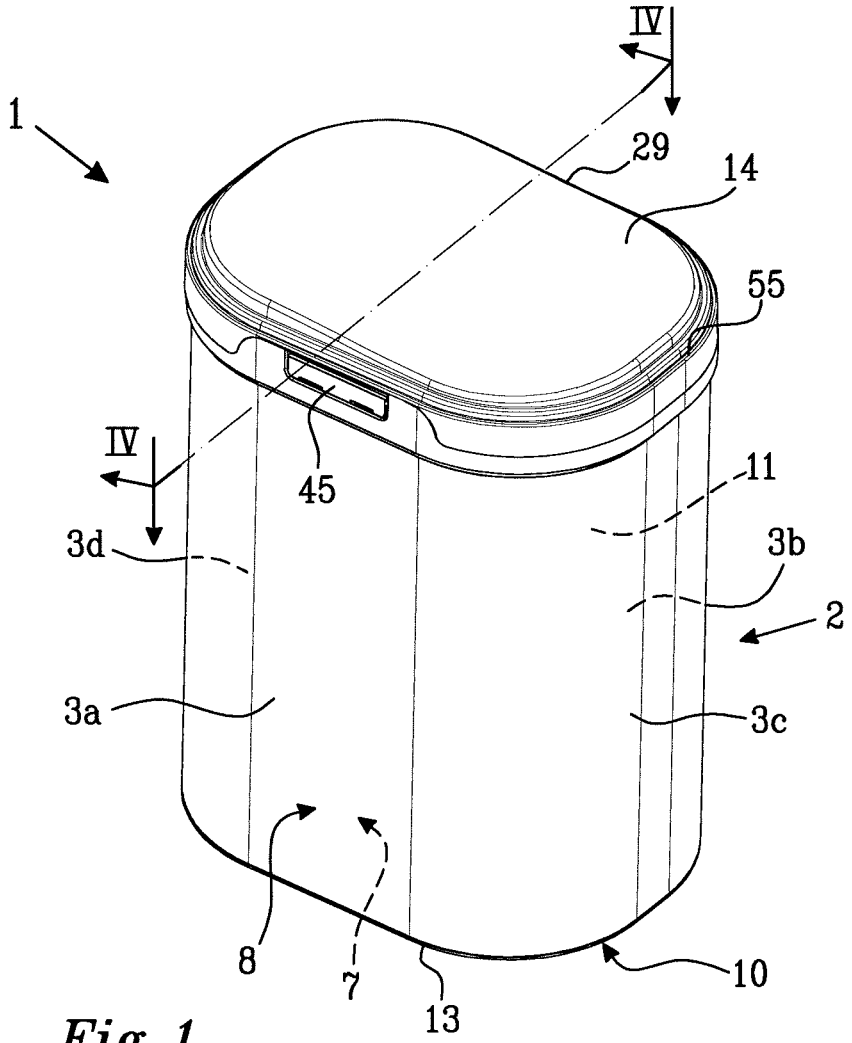
FIG. 1 shows a perspective view of a packaging container.

It is to be understood that the drawings are schematic and that individual components, such as layers of material are not necessarily drawn to scale. The packaging container, reinforcing rim and lid component shown in the figures are provided as examples only and should not be considered limiting to the invention. Accordingly, the scope of the invention is determined solely by the appended claims.

With reference to FIGS. 1-4, there is shown a paperboard packaging container 1 for pourable or scoopable bulk solids. The particular shape of the container 1 shown in the figures should not be considered limiting to the invention. Accordingly, a paperboard packaging container produced according to the invention may have any useful shape or size.

The packaging container 1 comprises a container body 2 formed by a tubular container wall 3 including a front wall portion 3*a*, a rear wall portion 3*b* and two side wall portions 3*c*, 3*d*. The container wall 3 extends in a height direction H of the packaging container 1 from a bottom end edge 4 at a bottom end of the container body to an upper end edge 5 at an upper end of the container body 2. The container body 2 has an upper body opening 6' at the upper end and a bottom body opening 6" at the bottom end. The container wall 3 has an inner surface 7 facing towards an inner compartment 11 in the packaging container 1 and an outer surface 8 facing away from the inner compartment 11 and being exposed to the exterior of the packaging container 1. A bottom disc 9 is positioned at the bottom edge 4 of the container body 2 and covers the bottom body opening 6". The container body 2 is made from paperboard material as defined herein. The container body 2 may be formed by bringing together the side edges of a web of paperboard causing the material to assume a tubular shape, whereafter the side edges are sealed together. Sealing of the side edges may be made by any suitable method as known in the art, such as by welding or gluing, with welding being preferred. Sealing of the side edges of the container body web may involve using a sealing strip which is applied over the join between the side edges, as known in the art. The bottom disc 9 may be made from paperboard, metal, plastic, or from any suitable combination of such materials as known in the art.

The container body bottom end edge 4 is reinforced by a plastic reinforcing bottom rim 10 which is applied to the inner surface 7 of the container wall 3, between the bottom disc 9 and the bottom end edge 4 and which has an outwardly directed flange 12 which covers the bottom end edge 4 and forms a bottom edge 13 of the packaging container 1. The bottom rim 10 reinforces the paperboard bottom end edge 4, stabilizes the shape of the container body 2 and protects the container body bottom edge 4 from mechanical deformation. The plastic bottom rim 10 also serves as a protective barrier against water and other fluids which may be present on a surface on which the packaging container is placed. The bottom rim 10 delimits a downwardly open space between the bottom disc 9 and the bottom edge 13 of the packaging container 1 which may be used to accommodate stacking elements arranged at an upper end of another packaging container when stacking two or more packaging containers on top of each other.

As an alternative to a plastic bottom rim, the bottom edge of the packaging container may be formed by a rolled edge of the paperboard container body, or may be provided by a simple, non-rolled join between the bottom disc 9 and the container body 2.

The closure by a bottom disc 9 may be replaced by a folded bottom portion, as known in the art.

The paperboard packaging container 1 is provided with a closure arrangement comprising a lid 14 and an upper reinforcing rim 15 extending along the container body opening edge 5 and defining a perimeter of a container access opening 35 which is smaller than the upper container body opening 6' which is defined by the upper end edge 5 of the tubular container body 2.

The upper reinforcing rim 15 is preferably a plastic rim, most preferably a thermoplastic rim and is attached to the inner surface 7 of the container body wall 3 at the upper body opening 6'. The upper reinforcing rim 15 has an extension in the height direction, H, of the container 1 and has a lower rim part 16 with a lower rim edge 17 facing towards the container bottom 9 and an upper rim part 18 with an upper rim edge 19 facing away from the container bottom 9. The upper reinforcing rim 15 extends around the full periphery of the upper body opening 6'. The upper rim part 18 protrudes upwards in the height direction, H, above the upper body end edge 5, whereby the upper edge 19 of the upper reinforcing rim 15 is arranged above the upper body end edge 5 in the height direction, H, of the packaging container 1.

The upper reinforcing rim 15 is joined to the inner surface 7 of the container wall 3 by means of a weld seal 20 extending around the container opening 6'. The weld seal 20 preferably extends continuously around the upper body opening 5 and is a sift-proof weld seal and is preferably also a moisture proof weld seal and most preferably a gas-tight weld seal.

The weld seal 20 is formed by supplying energy to heat and locally soften or melt one or more thermoplastic component in a thermoplastic rim 15 and/or in a coating or film on the inner surface 7 of the container body wall 3 and by pressing the reinforcing rim 15 and the container wall 3 together in a direction perpendicular to the container wall 3. The temperature and pressure can be controlled and adjusted to form a strong and tight seal without damaging the welded components. The thermoplastic material used to create the weld seal 20 may be provided by a fully or partly thermoplastic reinforcing rim 15, by a thermoplastic film or coating on the inner surface 7 of the container wall 3, or by both a fully or partly thermoplastic reinforcing rim and by a thermoplastic film or coating on the inner surface 7 of the container wall 3. A plastic reinforcing rim 15 is preferably made from thermoplastic material which allows it to be thermoformed, e.g. by injection molding. An injection molding process may be used to form plastic components having different polymer compositions in different parts of the plastic component. By way of example, the surface of a plastic reinforcing rim which is welded to the container body may be formed from a polymer composition having a lower softening and melting point than other parts of the reinforcing rim. Moreover, an abutment surface on the upper reinforcing rim 15 may be formed from a resilient thermoplastic polymer. Any suitable welding technique may be used, such as ultrasonic welding or high frequency welding, with high frequency welding being preferred.

Figure 3:
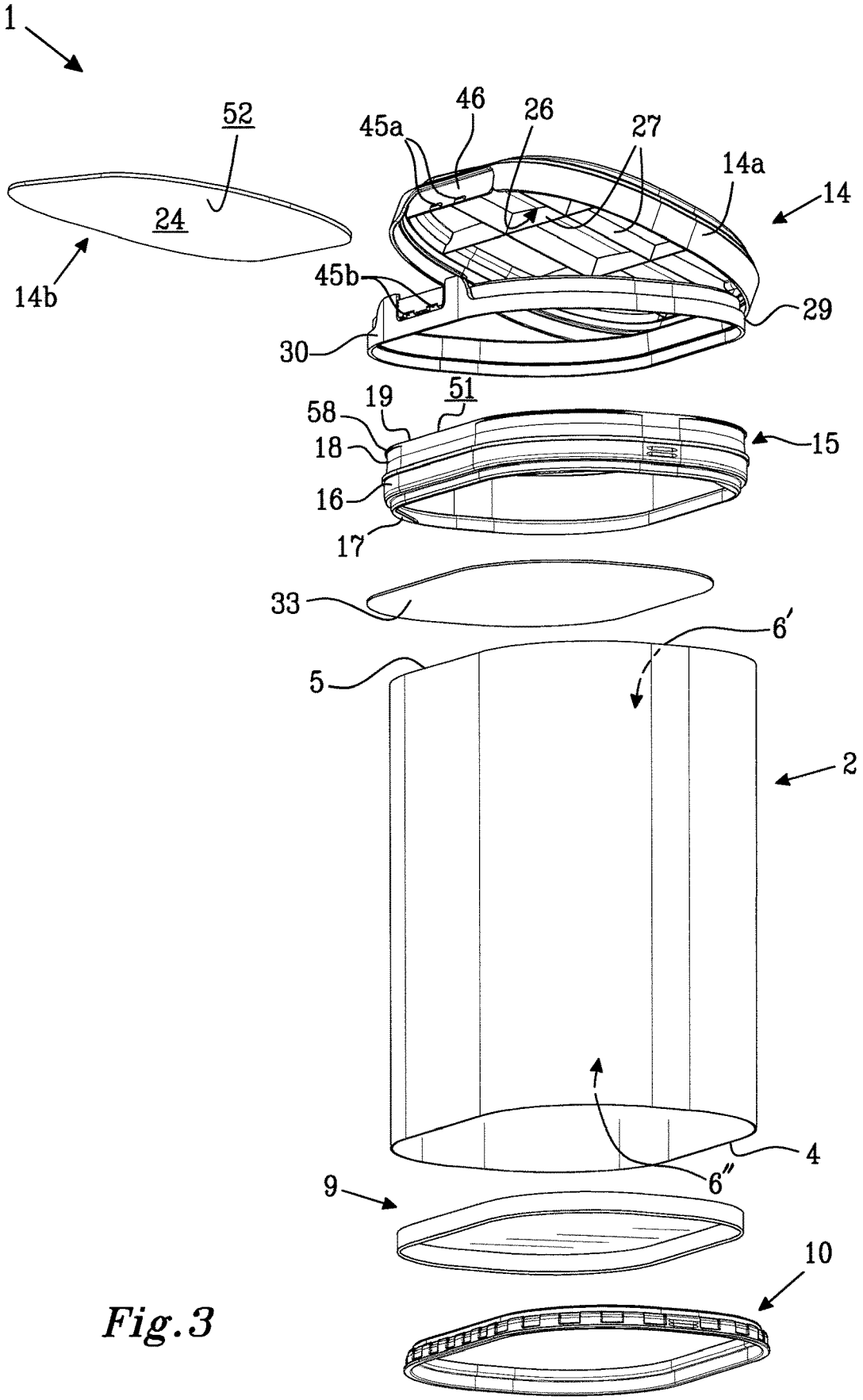
FIG. 3 shows an exploded view of the packaging container in FIG. 1.
Figure 4:
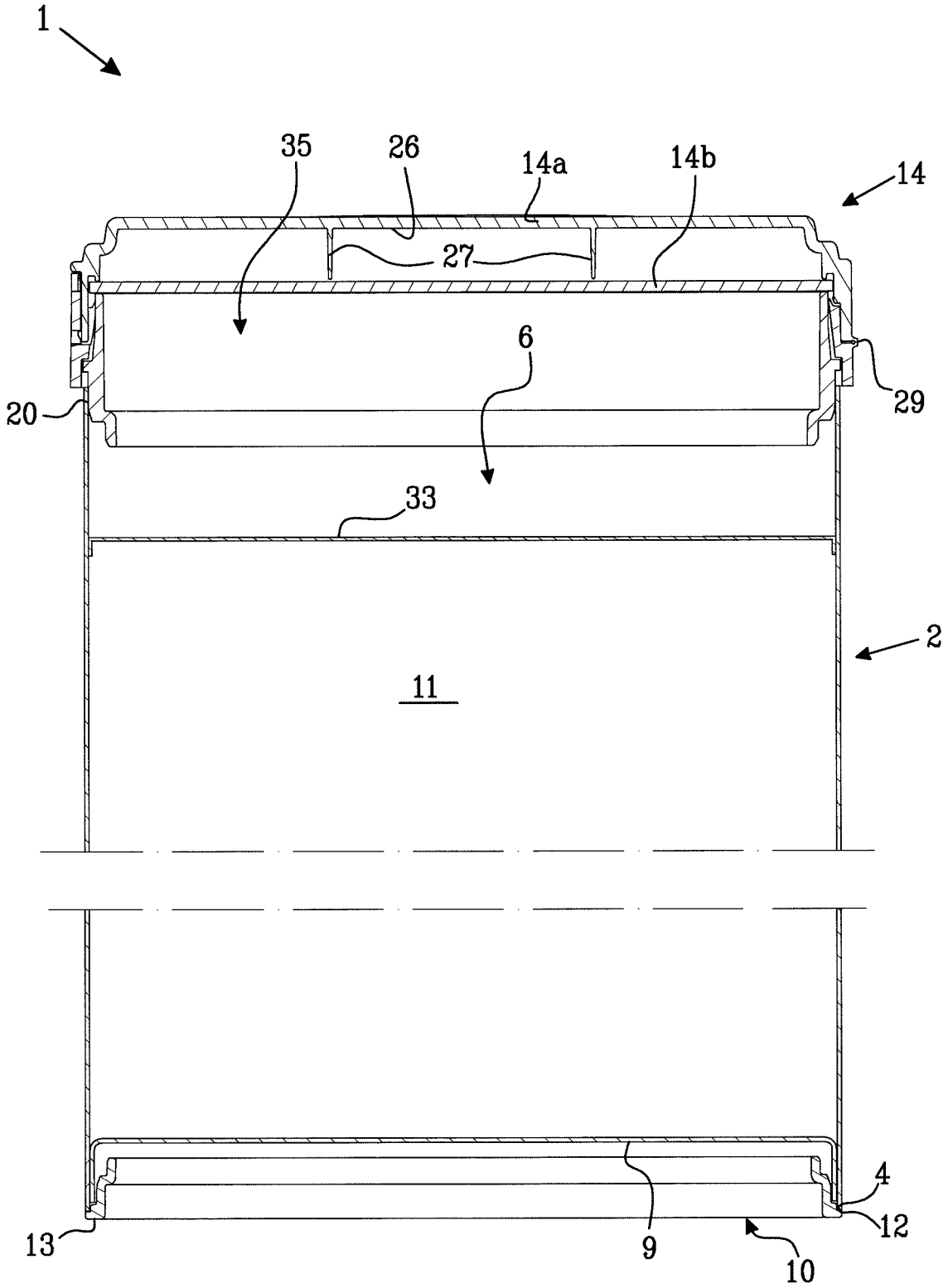
FIG. 4 shows a cross-section taken along the line IV-IV in FIG. 1.

The lid 14 is formed from an outer lid part 14*a* and an inner lid part 14*b*. The outer lid part 14*a* is a profiled part with a three-dimensional shape providing an upper outer surface 25 of the lid 14. As is shown in FIG. 3, the outer lid part 14*a* has an inner surface 26 comprising a pattern of reinforcing ribs 27. The inner lid part 14*b* is a planar disk. The inner lid part 14*b* has an inner lid surface 24 which faces towards the bottom disc 9 when the lid 14 is closed on the container access opening 35.

The outer lid part 14*a* is connected by a hinge 29 to a frame structure 30, the lid 14 and the frame structure 30 together forming a lid component 31. The hinge 29 is a live hinge, formed integrally with the upper lid part 14*a* and the frame structure 30 as a flexible connection between the upper lid part 14*a* and the frame structure 30. As set out herein, the illustrated hinge is only intended as a non-limiting example and it should be understood that any other type of functional hinge may be used for the connection between the frame structure and the lid. Moreover, the lid may be of the removable kind, without any permanent connection to the frame structure.

The frame structure 30 is applied to the packaging container at the container body opening edge 5 and is mechanically attached to the upper reinforcing rim 15 by a snap-on connection. The frame structure 30 is attached to the upper reinforcing rim 15 after the reinforcing rim 15 has been welded to the inner surface 7 of the paperboard container wall 3. The frame structure 30 is applied to the upper reinforcing rim 15 by pressing the frame structure 30 down over the upper edge 19 of the upper reinforcing rim 15 until the frame structure 30 locks in place on the upper reinforcing rim 15 by means of mating snap-in features on the upper reinforcing rim 15 and the frame structure 30. When the frame structure 30 has been attached to the upper reinforcing rim 15, it can only be removed again by breaking or damaging the snap-in connection between the rim 15 and the frame structure 30.

The interior compartment 11 is sealed at the upper end of the container body 2 with a fully or partly removable sealing membrane 33 which is sealed to the container body wall 3.

The interior compartment is filled with pulverulent material 34. The removable sealing membrane 33 may be attached to the container wall either from the top end of the container body 2 or from the bottom end of the container body 2 as disclosed herein.

In order to gain a first access to the packaged goods, a user needs to open the lid 14 and expose the packaged pulverulent material 34 by fully or partly removing the sealing membrane 33. The sealing membrane 33 may be arranged to be peeled away from the wall 3 of the container body 2 or may be arranged with means for breaking the membrane 33 so that it can be at least partly removed through the access opening 35. Such means may be in the form of one or more predefined weakenings, such as perforations or a cut partly through the membrane. When the membrane is of the tear-open type, a narrow edge part of the sealing membrane may be left at the inner surface 7 of the container wall 3. Any such remaining part of the sealing membrane should preferably not be so large so that it extends into the access opening which is defined by the inner perimeter of the upper reinforcing rim.

Figure 2:
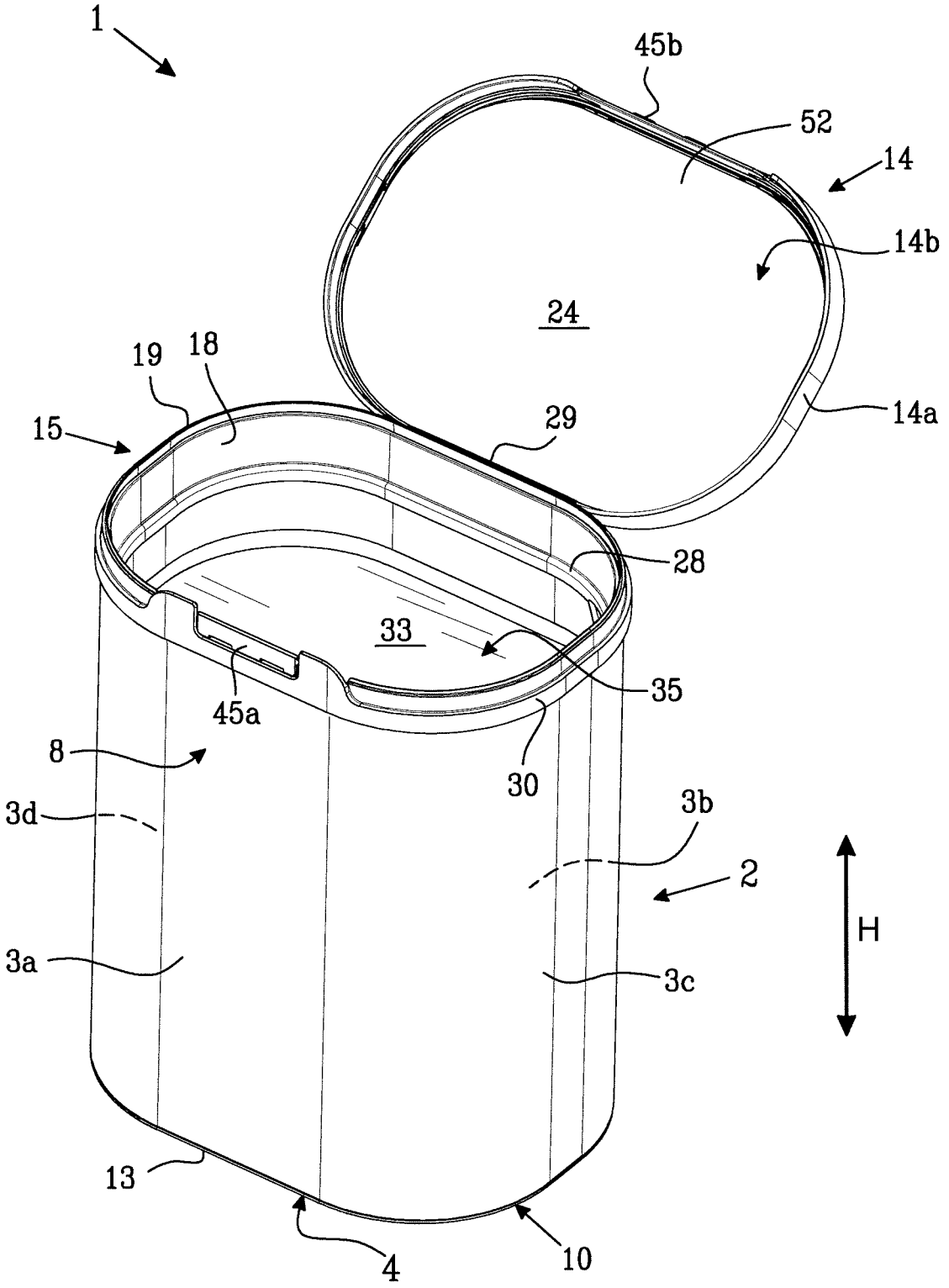
FIG. 2 shows a perspective view of the packaging container in FIG. 1 with an open lid.

Once the sealing membrane 33 has been removed, it is sufficient to open the lid 14 in order to gain access to the packaged goods 34 in the interior compartment 11 through the access opening 35. As is seen in FIG. 2, which reveals the inside of the upper reinforcing rim 15, the area of the access opening 35 is defined by an inner perimeter 28 or inner contour of the upper reinforcing rim 15. As the upper reinforcing rim 15 is applied on the inner surface 7 of the container body wall 3 and adds thickness to the body wall in an inward direction, the area of the access opening 35 is always smaller than the area of the upper body opening 6'.

When the packaging container 1 is open, a desired quantity of the packaged goods 34 may be removed from the packaging container 1 through the access opening 35 either by means of a scoop (not shown) or by pouring. The scoop may preferably be provided together with the packaging container 1. The scoop may initially be placed on the sealing membrane 33, may be removably attached to the inner lid surface 26 or may be attached to the upper reinforcing rim 15.

Figure 5:
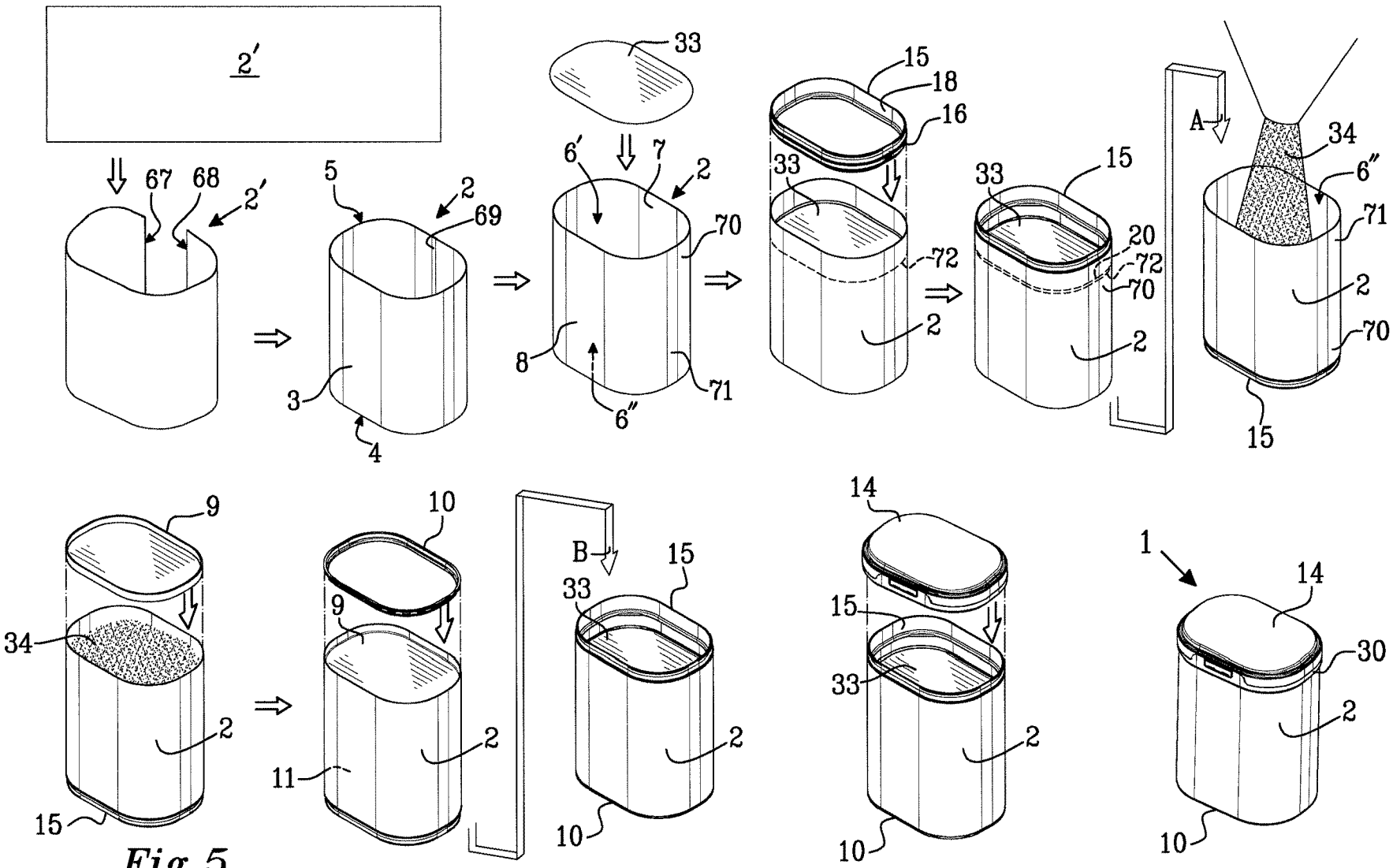
FIG. 5 shows schematically a process for producing and filling the packaging container in FIG. 1.

A packaging container as shown in FIGS. 1-4 may be produced and filled by the method illustrated in FIG. 5. The method involves forming a tubular container body 2 from a paperboard sheet 2' by bringing together the side edges 67,68 of the paperboard sheet 2', thus causing the material to assume a tubular shape. The side edges 67,68 of the paperboard sheet are then sealed together. Sealing of the side edges may be made by any suitable method as known in the art, such as by welding or gluing, with welding being preferred. In the process in FIG. 5, the side edges 67,68 of the container body sheet 2' are sealed using a sealing strip 69. The use of a sealing strip 69 is optional to the invention.

The container body 2 has an upper end 70 with an upper body opening 6' and a bottom end 71 with a bottom body opening 6" and a container wall 3 extending between the upper end 70 and the bottom end 71. The container wall has an inner surface 7, an outer surface 8, an upper end edge 5 and a bottom end edge 4.

The upper body opening 6' is closed by applying a sealing membrane 33 across the opening 6' and attaching a peripheral edge portion of the sealing membrane 33 to the inner surface 7 of the container wall 3 at a distance from the upper end edge 5 of the container wall 3. The sealing membrane 33 is preferably attached by being welded to the inner surface 7 of the container wall 3. The weld seal 72 may be a peelable seal or a permanent seal. If the weld seal is a permanent seal, the sealing membrane 33 is preferably provided with means to allow it to be torn open by a user. Such tearing means may be perforations or other tear indications as disclosed herein.

An upper reinforcing rim 15 in the form of a closed loop with a main extension in a loop plane is subsequently provides. The upper reinforcing rim 15 has an outer contour and an inner contour and a height in a height direction perpendicular to the loop plane. The upper reinforcing rim 15 has an upper rim part 18 and a lower rim part 16 in the height direction of the upper reinforcing rim 15 and is applied to the container body by inserting the lower rim part 16 into the upper body opening 6' of the container body 2. As set out herein, also the upper part 18 of the upper reinforcing rim 15 may be inserted into the container body. However, it should be ascertained that no part of the upper body end edge protrudes above the upper edge of the inserted upper reinforcing rim 15.

Accordingly, the upper reinforcing rim 15 is inserted into the container body 2 such that an upper end edge of the upper reinforcing rim 15 remains outside of the container body 2 or is flush with the upper end edge 5 of the container wall 3.

By inserting the upper reinforcing rim 15 which is more rigid than the container body 2 into the container body, the upper end edge 5 of the container body 2 is brought to conform to the outer contour of the upper reinforcing rim 15. Accordingly, the application of the upper reinforcing rim 15 to the container body wall 3 serves to bring the upper end edge 5 and thereby also the container wall 3 to assume a cross-sectional shape following the contour of the upper reinforcing rim 15.

A weld seal 20 is thereafter formed between the inner surface 7 of the container wall 8 and the inserted lower part 16 of the upper reinforcing rim 15. As described herein, the weld seal is preferably a high frequency weld seal and is formed by applying heat and pressure perpendicular to the container wall 3 to melt and locally soften thermoplastic components in the upper reinforcing rim 15 and/or on the inner surface 7 of the container body wall 3.

The partly assembled packaging container is then turned upside-down as indicated by the arrow A until the bottom body opening 6" and the bottom end 71 of the container body 2 comes to be directed upward and is introduced into a filling station where pulverulent material is filled into the container body 2 through the upwardly directed bottom body opening 6".

It should be understood that the upper reinforcing rim 15 may alternatively be attached while the packaging container 1 is in the upside-down position shown after the arrow A. In such case, the packaging container 1 already has the correct orientation when presented to the filling station and no turning step is carried out. The orientation of the packaging container during the initial steps of forming the tubular container body 2, applying the inner sealing membrane 33 and the upper reinforcing rim 15 is not critical to the invention. It is to be understood, that the container body 2 may be held in any suitable position during these process steps as long as it is presented to the filling station with the bottom opening directed upwardly as shown after the arrow A in FIG. 5.

Subsequently, the bottom body opening 6" is closed by attaching a bottom disc 9 to the inner surface 7 of the container body wall 3 such that the pulverulent material 34 becomes enclosed in an inner compartment between the sealing membrane 33 and the bottom disc 9. While the bottom disc may be made from any suitable material such as paperboard, plastic or metal, paperboard bottom disks may generally be preferred. The paperboard bottom disc 9 may be attached by welding, such as by high frequency welding, to the inner surface 7 of the container body wall 3. The bottom disc 9 is shaped before insertion into the bottom body opening 6" by bending the peripheral edges of the bottom disc 9 to create a flange that can be welded to the inner surface 7 of the container body wall 3. The weld seal between the bottom disc 9 and the container body wall 3 is much less sensitive to contamination by the packaged pulverulent material 34 than is the weld seal 72 between the inner sealing membrane 33 and the inner surface 7 of the container body wall 3. The bottom disc 9 is generally thicker and more compressible than the sealing membrane 33 and is easier to form into a tight seal with the container body wall 3. Furthermore, the amount of pulverulent material 34 which may escape out of the packaging container 1 when the bottom disc 9 is inserted into the bottom body opening 6" is very small, as the bottom disc 9 is only inserted a very small distance into the container body 2, thus generating only a minimum of turbulence at the surface of the packaged pulverulent material 34. In addition, any pulverulent material which ends up on the outside of the bottom disc 9 after the packaging container has been closed can be easily removed and will never be seen by a user of the packaging container.

After the bottom disc 9 has been applied over the bottom body opening 6", a bottom reinforcing rim 10 is attached to the inner wall 7 of the container body 2 at the bottom end 71 of the container body 2. The bottom reinforcing rim 10 has a an outer contour and an inner contour and a height in a height direction perpendicular to a bottom loop plane and has an upper rim part and a lower rim part in the height direction of the bottom reinforcing rim 10. By inserting the upper rim part of the bottom reinforcing rim 10 and optionally also the lower rim part of the bottom reinforcing rim 10 into the tubular container body 2 at the bottom end edge 4 of the container body 2, the bottom end edge 4 of the container body 2 is brought into conformance with the outer contour of the bottom reinforcing rim 10. As with the upper reinforcing rim 15, the bottom reinforcing rim 10 may have a bottom end edge outside of the container body 2 or flush with the bottom end edge 4 of the container wall 3.

The application of a bottom reinforcing rim 10 to the bottom end of the packaging container is optional to the process as disclosed herein.

The partly assembled packaging container is then turned again as indicated by the arrow B until the upper end 70 of the container body 2 comes to be directed upward whereafter a lid component 31 including a lid 14 and a frame structure 30 is snapped onto the upper reinforcing rim 15 to produce the fully assembled and filled packaging container 1.

It is to be understood that the upper body opening 6' may alternatively be closed with the sealing membrane after the upper reinforcing rim 15 has been applied to the container body 2. A further alternative is to apply the sealing membrane 33 from the bottom end 71 of the container body 2 which is preferably be done after the container body has been turned upside-down as indicated by the arrow B in FIG. 5. Accordingly, the sealing membrane 33 can be applied at any suitable point in the process, as long as it is applied before the filling step, as the sealing membrane 33 is needed to keep the pulverulent material in the container body 2 during the filling step.

It is also to be understood that it is optional to the process as disclosed herein to apply a frame structure/lid component to the upper reinforcing rim 15. Accordingly, the filled and bottom-sealed packaging container may alternatively be provided with a lid which is directly applied to the upper reinforcing rim 15, either as a completely removable lid or as a lid which is attached to the upper reinforcing rim 15 by means of a two-part hinge.

It is an advantage of a lid construction as shown in the figures that a frame structure 30 or a whole lid component 31 can be attached to the upper reinforcing rim 15 after the container 1 has been filled and closed around the contents 34. In this manner, the risk that the lid component 31 or frame structure 30 is damaged in the production and filling process is minimized. Furthermore, by attaching a three-dimensionally shaped lid component 31 or frame structure 30 at a late stage in the process, the packaging container 1 can be filled from the bottom end of the container body 2, which means that the sealing membrane 33 can be applied in the packaging container before the container is filled. An advantage with applying the sealing membrane 33 in the packaging container before the packaging container is filled with pulverulent material is that there is no risk that the seal between the membrane and the container wall is contaminated by the pulverulent material. Furthermore, there is no risk that any of the packaged pulverulent material will end up outside the sealing membrane, in the space between the lid and the sealing membrane, which may happen if the sealing membrane is applied after filling of the packaging container. A user opening a new packaging container for a first time and finding some of the contents outside the sealing membrane would consider the container to be less hygienic and reliable than a container in which the space between the sealing membrane and the lid is completely clean.

By arranging the seal between the container wall and the reinforcing rim on the inside of the container wall as disclosed herein, the join between the reinforcement rim 15 and the container wall 3 forms a continuous barrier on the inside of the container. The plastic reinforcement rim 15 is more rigid than the container wall 3 and constitutes a shape stable continuation of or supplement to the paperboard container wall 3 and provides a first abutment surface which is resistant to deformation when pressed against a second abutment surface on the inner surface of the lid 14 and permits the packaging container 1 to be repeatedly opened and closed without risk of damaging the upper body end edge 5 and thereby impairing container tightness. The effective weld seal 20 between the reinforcing rim 15 and the inner surface 7 of the container wall in conjunction with the non-deformable abutment surface on the reinforcement rim 15 provide a container as disclosed herein with improved resealability and tightness after a first opening of the container by a consumer and after any internal sealing membrane or other transport seals have been broken.

The invention claimed is:

1. A method of producing and filling a paperboard packaging container with pulverulent material wherein the method comprises the steps of:

a) forming a tubular container body from a paperboard sheet, said container body having an upper end with an upper body opening and a bottom end with a bottom body opening and a container body wall extending in a height direction of said packaging container between said upper body opening and said bottom body opening, said container body wall having an inner surface and an outer surface, an upper end edge and a bottom end edge;

b) closing said upper body opening with a sealing membrane which is attached to said inner surface of said container body wall;

c) providing an upper reinforcing rim in the form of a closed loop having a main extension in a loop plane, said upper reinforcing rim having an outer contour and an inner contour and having a height in a height direction perpendicular to said loop plane with an upper rim part and a lower rim part in said height direction of said upper reinforcing rim;

d) inserting said lower rim part of said upper reinforcing rim and optionally also said upper rim part of said upper reinforcing rim into said tubular container body at said upper body opening with an upper end edge of said upper reinforcing rim being outside of said container body or flush with said upper end edge of said container wall;

e) forming a weld seal between said inner surface of said container wall and said inserted part of said upper reinforcing rim;

f) presenting said container body to a filling station with said bottom body opening of said container body directed upward in a vertical direction;

g) filling pulverulent material into said container body through said upwardly directed bottom body opening;

h) closing said bottom body opening; and i) applying a lid at said upper end of said container body after closing said bottom body opening in step h, wherein steps a to f are performed before steps g to i, and step b is performed between steps a and c or is performed between steps e and f.

2. The method according to claim 1, wherein said upper end edge is directed upward in the vertical direction and said bottom end edge is directed downward in the vertical direction during steps d and e, and wherein step 1 includes turning said container body upside-down with said upper end edge directed downward in the vertical direction and said bottom end edge directed upward in the vertical direction.

3. The method according to claim 1, wherein said closing step h is carried out by attaching a bottom disc to said inner surface of said container body wall.

4. The method according to claim 1, further comprising the step of:

j) applying a frame structure by mechanically attaching said frame structure to said upper reinforcing rim after closing said bottom body opening in step h, wherein application of said frame structure is performed either before application of said lid in step i or at the same time as applying said lid in step i by applying said frame structure as part of a lid component, said lid component further including said lid, said lid and said frame structure being connected by a hinge.

5. The method according to claim 4, wherein said attachment between said frame structure and said upper reinforcing rim is made by forming a snap-in connection between said frame structure and said upper reinforcing rim.

6. The method according to claim 3, further comprising the steps of:

k) providing a bottom reinforcing rim in the form of a closed loop extending in a bottom rim plane, said bottom reinforcing rim having a an outer contour and an inner contour and having a height in a height direction perpendicular to said bottom rim plane with an upper rim part and a lower rim part in said height direction of said bottom reinforcing rim;

l) inserting said upper rim part of said bottom reinforcing rim and optionally also said lower rim part of said bottom reinforcing rim into said tubular container body at said bottom end edge with a bottom end edge of said bottom reinforcing rim being outside of said container body or flush with said bottom end edge of said container wall; and m) attaching said bottom reinforcing rim to said inner surface of said container body wall.

7. The method according to claim 6, wherein said bottom reinforcing rim is attached by welding.

8. The method according to claim 1, wherein said weld seal between said upper reinforcing rim and said inner surface of said container body wall is formed by high frequency welding.

9. The method according to claim 1, wherein said weld seal between said upper reinforcing rim and said inner surface of said container body wall is formed continuously around said upper body opening.

10. The method according to claim 1, wherein a degassing step is performed in conjunction with said filling step g.

11. The method according to claim 10, wherein said degassing step includes supplying a protective gas to a flow of pulverulent material in the filling step g.

12. The method according to claim 10, wherein said degassing step includes performing said closing step in a protective gas atmosphere.

* * * * *